US007139496B1

(12) United States Patent
Roof et al.

(10) Patent No.: US 7,139,496 B1
(45) Date of Patent: Nov. 21, 2006

(54) WITHIN PAGE CREEP VARIATION FOR IMPROVED STRIPPING

(75) Inventors: Bryan J. Roof, Fairport, NY (US); Donald M. Bott, Rochester, NY (US); Anthony S. Condello, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/166,317

(22) Filed: Jun. 24, 2005

(51) Int. Cl.
*G03G 15/00* (2006.01)

(52) U.S. Cl. ..... 399/45; 399/323

(58) Field of Classification Search ..... 399/45, 399/323, 398
See application file for complete search history.

(56) References Cited

U.S. PATENT DOCUMENTS

| | | | | |
|---|---|---|---|---|
| 3,934,113 | A | 1/1976 | Bar-on | |
| 4,042,804 | A | 8/1977 | Moser | |
| 4,257,699 | A | 3/1981 | Lentz | |
| 4,711,818 | A | 12/1987 | Henry | |
| 5,017,432 | A | 5/1991 | Eddy et al. | |
| 5,061,965 | A | 10/1991 | Ferguson et al. | |
| 5,406,362 | A * | 4/1995 | Mills | 399/126 |
| 5,621,512 | A * | 4/1997 | Uehara et al. | 399/328 |
| 5,729,813 | A | 3/1998 | Eddy et al. | |
| 5,998,761 | A | 12/1999 | Berkes et al. | |
| 6,246,858 | B1 | 6/2001 | Condello et al. | |
| 6,253,046 | B1 * | 6/2001 | Horrall et al. | 399/124 |
| 6,289,587 | B1 | 9/2001 | Abe et al. | |
| 6,494,570 | B1 * | 12/2002 | Snyder | 347/103 |
| 6,581,456 | B1 | 6/2003 | Clark | |
| 6,587,664 | B1 * | 7/2003 | Baughman et al. | 399/331 |
| 6,618,890 | B1 | 9/2003 | Muhr-Sweeney | |
| 6,772,628 | B1 | 8/2004 | Clark | |
| 6,782,233 | B1 | 8/2004 | Condello et al. | |
| 6,795,677 | B1 | 9/2004 | Berkes et al. | |
| 6,819,890 | B1 | 11/2004 | Bott et al. | |
| 2003/0128994 | A1 * | 7/2003 | Holubek et al. | 399/45 |
| 2003/0170056 | A1 | 9/2003 | Condello et al. | |
| 2004/0028433 | A1 | 2/2004 | Berkes et al. | |
| 2004/0052555 | A1 | 3/2004 | Berkes et al. | |
| 2004/0151515 | A1 * | 8/2004 | Nakayama | 399/67 |
| 2004/0151521 | A1 | 8/2004 | Rasch et al. | |

* cited by examiner

*Primary Examiner*—David M. Gray
*Assistant Examiner*—Bryan Ready
(74) *Attorney, Agent, or Firm*—Fay, Sharpe, Fagan, Minnich & McKee, LLP

(57) ABSTRACT

A fuser system and method for a xerographic device having improved self-stripping capabilities for a wide latitude of substrate media. The fuser system includes a fuser member and a pressure member in which the pressure member is made to exert a predetermined pressure upon the fuser member. In applying this pressure load, a nip is formed having a nip width between the fuser member and the pressure member. A predetermined creep exists during normal fusing of a substrate. A load adjustment device is provided to momentarily increase the exerted pressure as a leading edge or other portion of the substrate passes through, and/or in the vicinity of, the nip, thereby increasing the creep magnitude momentarily and improving self-stripping capabilities.

26 Claims, 5 Drawing Sheets

FIG. 7
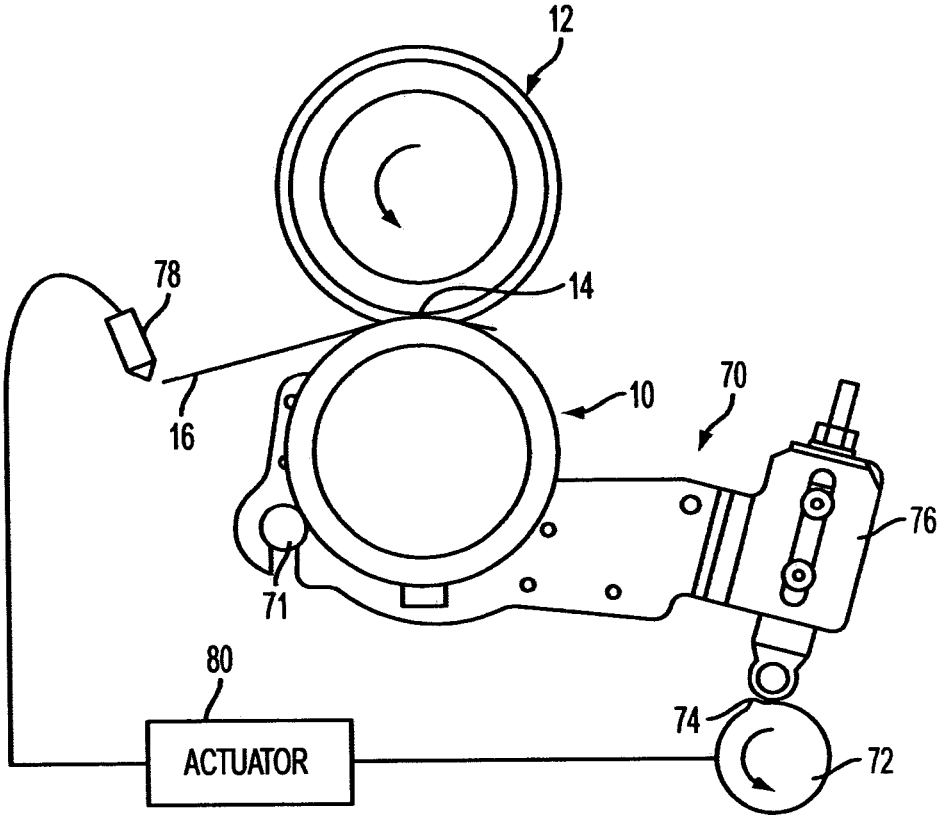
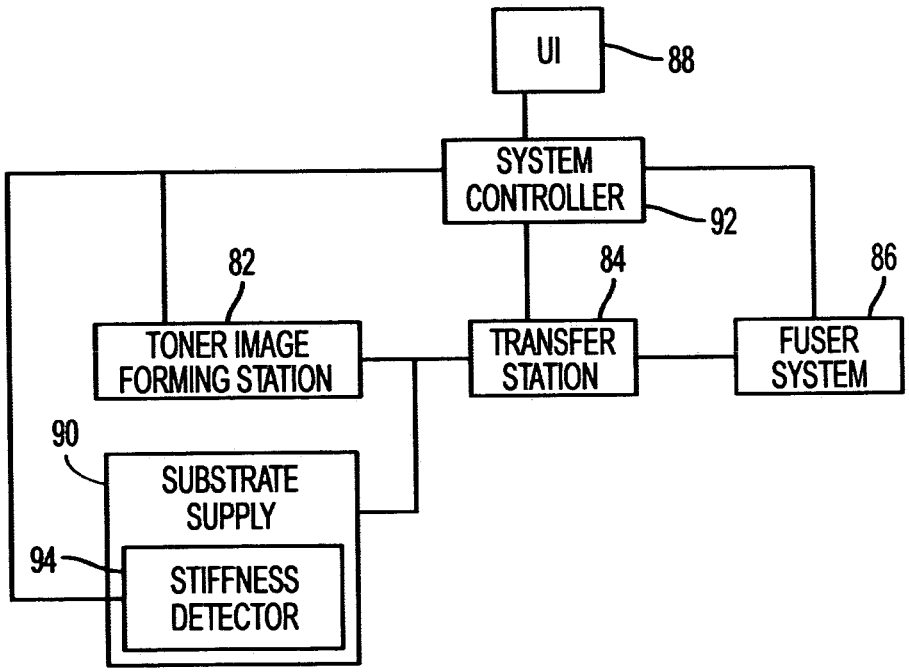
FIG. 8

WITHIN PAGE CREEP VARIATION FOR IMPROVED STRIPPING

BACKGROUND

1. Field of Disclosure

This disclosure relates to a fuser system for a xerographic device that includes a fusing member and a pressure member. More particularly, the disclosure relates to improved self-stripping of a substrate from the fusing member as the substrate leaves a nip formed between the fusing member and pressure member.

2. Description of Related Art

In the art of xerography or other similar image reproducing arts, a latent electrostatic image is formed on a charge-retentive surface, i.e., a photoconductor or photoreceptor. To form an image on the charge-retentive surface, the surface is first provided with a uniform charge, after which it is exposed to a light or other appropriate image of an original document to be reproduced. The latent electrostatic image thus formed is subsequently rendered visible by applying any one of numerous toners specifically designed for this purpose.

It should be understood that, for the purposes of the present disclosure, the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. The particular method by which the image is formed is not critical to the present disclosure, and any such suitable method may be used.

In a typical xerographic device, the toner image formed is transferred to an image receiving substrate such as paper. After transfer to the image receiving substrate, the image is made to adhere to the substrate using a fuser apparatus. To date, the use of simultaneous heat and contact pressure for fusing toner images has been the most widely accepted commercially, the most common being systems that utilize a pair of pressure-engaged rolls.

The use of pressure-engaged rolls for fixing toner images is well known in the art. See, for example, U.S. Pat. Nos. 6,618,890, 6,289,587, 5,998,761, 4,042,804 and 3,934,113.

At the time of initial set-up of a xerographic device, the fuser system is set to be within certain specifications for, e.g., nip width, paper velocity and creep. Nip width is one of the more significant drivers of image fix and quality. Paper velocity is an important factor in paper handling. Creep, which is the release surface's extension in the nip, is important with respect to enabling the release of the paper and image from the fusing member. These specifications are set by, for example, setting a roll rotation speed for the paper velocity and setting the nip width for the dwell time and creep.

The creep is a function of the load between the fusing member and pressure member and other parameters, including the elasticity or softness of the two members. It is known that higher magnitudes of creep are effective in improving the self-stripping capabilities of the fuser system over a wide latitude of substrate media. Unfortunately, higher magnitudes of creep also mean higher levels of strain energy in the fuser roll materials when in the nip vicinity, thereby shortening the longevity of the fuser roll.

What is required is an improved method of improving the self-stripping capabilities of a fuser system for a wider latitude of substrate media without significantly increasing the strain energy within the fusing member materials.

BRIEF DESCRIPTION

A fuser system of a xerographic device of the present disclosure includes a fuser member and a pressure member in which the pressure member is made to exert a predetermined pressure upon the fuser member. In applying this pressure load, a nip is formed having a nip width between the fuser member and the pressure member. A predetermined creep level exists between these two members during normal fusing of a substrate. A load-adjustment device is provided to momentarily increase the exerted load pressure as the substrate passes through, and/or in the vicinity of, the nip, thereby increasing the creep magnitude momentarily, and effectively improving the self-stripping capabilities of the fuser system.

The present disclosure also provides a xerographic device including a toner image forming station, a transfer station to transfer the toner image to an image receiving substrate, and a fuser system. The fuser system includes a fuser member and a pressure member in which the pressure member is made to exert a predetermined load upon the fuser member. A nip is consequently formed, having a nip width between the fuser member and the pressure member, establishing a predetermined creep and pressure magnitude. A creep adjustment system is provided to momentarily increase the creep magnitude as a leading edge of the substrate passes through, and/or in the vicinity of, the nip to improve the self-stripping capabilities of the fuser system.

A method is also provided by the present disclosure for improved self-stripping latitude associated with a fuser member and a pressure member in which the pressure member is made to exert pressure upon the fuser member so as to form a nip having a nip width between the fuser member and the pressure member, establishing also a predetermined creep magnitude at least during normal fusing of a substrate. The method includes momentarily increasing the creep magnitude as a leading edge of the substrate passes though, and/or in the vicinity of, the nip.

Further still, a xerographic system is provided which includes a user interface for receiving instructions from a user and displaying system status messages to the user. A fuser member and a pressure member are included in which the pressure member exerts a predetermined pressure load upon the fuser member so as to form a nip having a nip width between the fuser member and the pressure member at least during normal fusing of a substrate. A predetermined creep magnitude is also established at least during the normal fusing of the substrate. A load adjustment system is configured to adjust the exerted load as substrate passes through, and/or in the vicinity of, the nip, thereby adjusting the creep magnitude, and a control system controls the load adjustment system based on a determination of the substrate properties.

BRIEF DESCRIPTION OF THE DRAWINGS

FIG. 7 is a fuser roll and a pressure roll for a belt-less xerographic device including a creep adjusting mechanism; and FIG. 8 is a schematic representation of a xerographic machine including the embodiment of FIG. 7.

DETAILED DESCRIPTION

There is illustrated herein, in embodiments, methods and systems, a heat and pressure fusing apparatus for fixing images to a final substrate that exhibits reliable stripping for a wide latitude of substrate media and a wide range of performance requirements, but with minimal apparatus wear. Embodiments are described in detail with reference to electrophotographic or xerographic print engines. However, it is to be appreciated that embodiments associated with other imaging or rendering technologies are contemplated.

A typical xerographic machine includes at least a toner image forming station, a transfer station to transfer the toner image to an image receiving substrate, and a fuser system to fix the toner image to the image receiving substrate. At the toner image forming station, a latent image of an original image is developed, typically on the surface of a photoconductor or photoreceptor, using a suitable toner material. The developed toner image is then transferred to an image receiving substrate such as paper, a transparency, etc., at a transfer station. Following transfer to the image receiving substrate, the toner image must then be fixed to the image receiving substrate, which is done by a fuser system that applies heat and pressure to the substrate having the toner image thereon.

A fuser system of the present disclosure is comprised of a fuser member that may be comprised of, for example, a fuser roll, or a fuser belt traveling around one or more (fuser) rolls. The term "fuser member" as used herein collectively refers to any configuration of a fuser used to contact the toner image in fixing the toner image to the image receiving substrate. Similarly, the fuser system of the present disclosure is comprised of a pressure member that may be comprised of, for example, a pressure roll, or a pressure belt traveling around one or more rolls. The term "pressure member" as used herein collectively refers to any member loaded against the fuser member and used to apply pressure to the image and media passed between the fuser member and pressure member.

Concepts of the present disclosure are equally adapted to belt fuser systems, but the present disclosure is more easily described with respect to a roll-based fusing system, and will, therefore, be described with reference hereinafter to a roll-based fusing system. A roll fuser system preferably comprises a set of at least one pair of a fuser roll and a pressure roll. A fuser system may include one or more sets of fuser and pressure rolls, as appropriate. However, for ease of illustration and description, embodiments of the present disclosure are described with respect to one set of fuser and pressure rolls.

Figure 1:
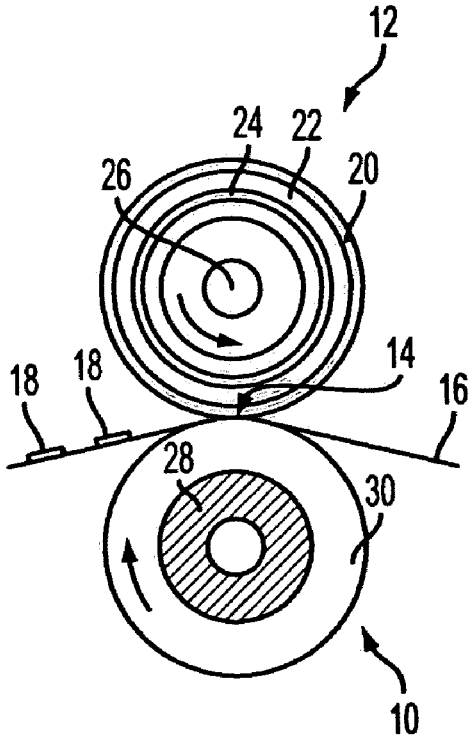
FIG. 1 is a fuser roll and a pressure roll for a belt-less xerographic device.

With reference now to FIG. 1, a pressure roll 10 is pressure engaged with fuser roll 12, thereby forming a nip 14 having a nip width defined by the width of the contact area between the pressure roll and the fuser roll. An image receiving substrate 16 having a toner image 18 thereon is made to pass through the nip such that the toner image contacts the fuser roll surface. The toner image is fixed to the image receiving substrate via heat and pressure. As the image receiving substrate exits from the fuser system, the image receiving substrate is stripped from the fuser roll. It is desirable that the stripping is self-stripping, however, stripping fingers or other stripping devices as described above may also be used to assist in the stripping as is well known in the art. Also, as described above, self-stripping of lightweight paper is difficult to achieve, and it is an object of the present disclosure to improve the self-stripping characteristics of the fuser system in order to minimize the use of stripping devices, or at least to minimize the amount of force required by the stripping devices.

The fuser member of the present disclosure may have any construction and design, without limitation. However, the disclosure as it relates to improving the self-stripping capability of the fuser system is more applicable to fuser systems having a nip-forming fuser member (NFFM) as shown, in which the fuser member is deforming more than the pressure member in the nip, as opposed to systems having a nip-forming pressure member (NFPM) as will be made clearer with a continued reading of the disclosure.

In a preferred embodiment, the fuser member is a fuser roll that includes at least one layer including a silicone material. The fuser roll 12 preferably includes an outer layer 20 and an optional intermediate layer 22 upon suitable base member 24 which may be either a solid or hollow cylinder or core fabricated from any suitable metal such as aluminum, anodized aluminum, steel, nickel, copper, and the like. Hollow cylinders or cores are preferred as such can be heated from inside the cylinder or core. For example, a suitable heating element 26 may be disposed in the hollow portion of the cylinder or core. Alternatively, any suitable external heating option may also be used.

The outer layer 20 of the fuser member is preferably comprised of a fluoroelastomer or fluoroplastic, as conventional in the art. The fluoroelastomer may include a silicone material therein. Suitable fluoroelastomers include FFKM elastomers and hydrofluoroelastomers. Illustrative FFKM elastomers are perfluororubbers of the polymethylene type having all substituent groups on the polymer chain either fluoro, perfluoroalkyl, or perfluoroalkoxy groups. The hydrofluoroelastomers (also known as FKM elastomers) are those defined in ASTM designation D1418-90 and are directed to fluororubbers of the polymethylene type having substituent fluoro and perfluoroalkyl or perfluoroalkoxy groups on a polymer chain.

The fluoroelastomers may be those described in detail in U.S. Pat. Nos. 4,257,699, 5,017,432 and 5,061,965. As described therein, these fluoroelastomers, particularly from the class of copolymers, terpolymers and tetrapolymers of vinylidenefluoride hexafluoropropylene, tetrafluoroethylene, and a cure site monomer (believed to contain bromine), are known commercially under various designations as the VITON™ line of fluoroelastomers available from E.I. DuPont de Nemours, Inc. Other commercially available materials include the FLUOREL™ line of fluoroelastomers available from 3M Company. Additional commercially available materials include AFLAS™, a poly(propylene-tetrafluoroethylene) copolymer, FLUOREL II™, a poly(propylene-tetrafluoroethylene-vinylidenefluoride) terpolymer, both also available from 3M Company.

Fillers, for example alumina fillers, heat stabilizers, etc., may be included in the outer layer, as well known in the art. See, for example, U.S. Pat. Nos. 4,711,818 and 5,729,813.

The outer surface layer of the fuser member preferably has a thickness of from about 1 to about 20 mils. One or more optional intermediate layers may be positioned between the substrate and the outer fluoropolymer/silicone layer. The intermediate layers preferably comprise a silicone rubber of a thickness so as to form a conformable layer. Suitable silicone rubbers include room temperature vulcanization (RTV) silicone rubbers; high temperature vulcanization (HTV) silicone rubbers and low temperature vulcanization (LTV) silicone rubbers. These rubbers are known and readily available commercially such as the SILASTIC™ line from Dow Corning and the RTV Silicone Rubber line from General Electric. Other suitable silicone materials include siloxanes (preferably polydimethylsiloxanes) such as fluorosilicones, dimethylsilicones, liquid silicone rubbers such as vinyl crosslinked heat curable rubbers or silanol room temperature crosslinked materials, and the like. Any suitable fillers may be included in the intermediate layer. In general, an intermediate layer preferably has a thickness of from about 0.05 to about 10 mm, preferably from about 0.1 to about 7 mm, and preferably from about 1 to about 5 mm.

Other layers such as adhesive layers or other suitable layers may be incorporated between the outer layer and the intermediate layer in embodiments, or between the substrate and the intermediate layer in embodiments.

Optionally, a delivery system including a sump containing release agents may be associated with the fuser roll so as to be able to apply release agents to the outer surface of the fuser roll.

Backup or pressure roll 10 cooperates with the fuser roll 12 to form the nip 14. The pressure roll preferably comprises a rigid hollow aluminum (or other suitable hard material) core 28 with a surface layer 30 thereon. The nip, however, is formed primarily within the fuser roll 12 in a NFFM system, i.e., by compression of the softer out layers 20, 22 of the fuser roll. The fuser member 10 preferably exhibits an initial hardness of from about 30 to about 120 Shore A, preferably from about 40 to about 90 Shore A.

In fusing, the ability to self-strip is governed by a number of mechanisms. There is the work of adhesion, i.e., the work to physically separate the toner, in tension with the fuser member, from the fuser member, the work of the elastic elements, i.e., the recovered strain energy as the rubber or elastomer surface of the fuser roll leaves the nip, and the work of the paper or other substrate in bending at the exit from the nip. It is intuitive that, in order for the paper to self-strip, the combined work of elastics and work of paper should be greater than the work of adhesion. The present disclosure deals specifically with a momentary modification to increase the work of elastics to thereby increase the likelihood of self-stripping.

It has been determined that, in a nip forming fuser member, the peripheral speed of the elastomer-covered member outside the nip is slightly lower than the peripheral speed of the substrate or pressure roll. The fractional difference between speeds is the creep for this embodiment and is equal to the surface strain in the nip.

Figure 2:
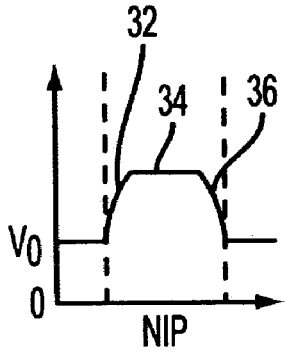
FIG. 2 is a representative graph showing surface speed of the fuser roll of FIG. 1.

Creep has been found to help overcome the adhesion of the toner-laden substrate, and to further enable self-stripping. Typical values of creep for black and white imaging fall in the range of 2.5% to 3%. In color imaging, creep is typically of the order of 5%. There are essentially three regions of surface speed in the nip 14 of an NFFM as shown in FIG. 1. With reference to FIG. 2 which shows the peripheral velocity of the fuser roll 12, there is a region of initial stretching 32 of the fuser roll elastomer as it first contacts the nip, a zone of speed lock-up 34 where driving of the fuser roll takes place, and a region of deceleration 36 back to the outside peripheral speed as the elastomer exits the nip, from left to right as shown. The release of the elastic energy, as a point on the elastomer surface exits the nip, helps to overcome the adhesion of the substrate to the fuser roll.

Figure 3:
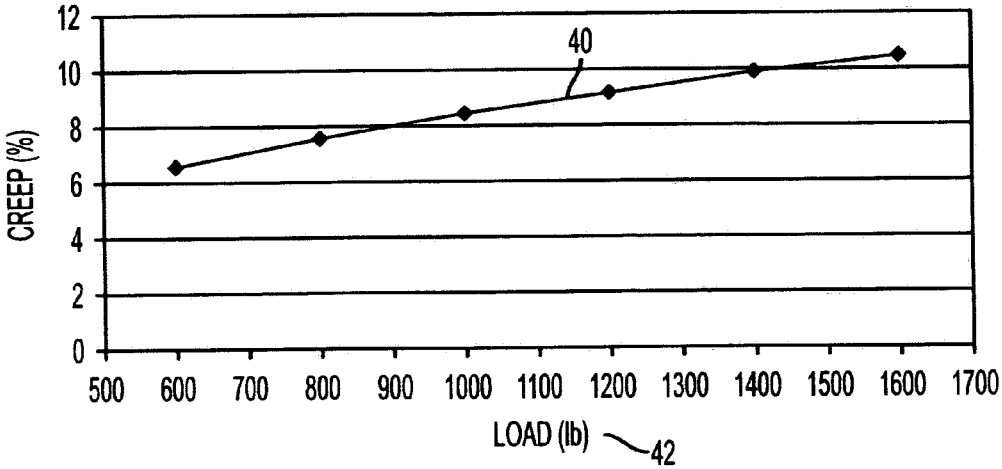
FIG. 3 is a representative graph of creep versus fuser roll load.
Figure 4:
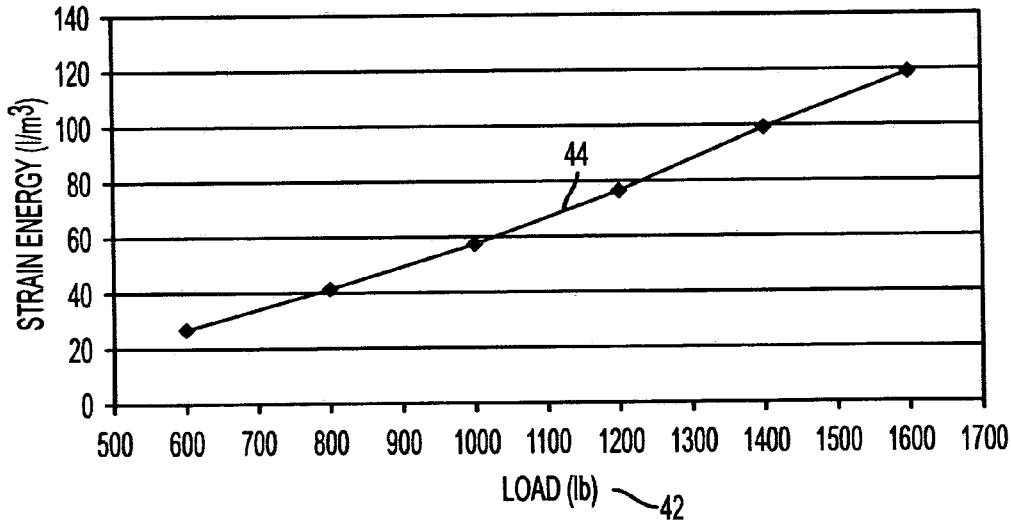
FIG. 4 is a representative graph of strain energy versus fuser roll load.

With reference now to FIG. 3, the creep 40 as a function of load 42 is shown for a typical NFFM. It may be observed that, as the load 42 increases, the creep 40 also increases. A corresponding strain energy 44 is shown in FIG. 4 as a function of the load 42, and it can be seen that the increase in creep results in a corresponding increase in strain energy, thereby improving stripping ability. Based on this result, it is reasonable to ask, if the stripping is so much improved with higher creep, why not run at a higher creep level continuously? The answer lies in the strain energy imparted to the fuser roll elastomer materials. It is obvious that the fuser roll material life would be compromised if run continuously at the higher strain energies created by the increased load. Generally speaking, the higher the strain energy, the lower the resulting material life. Thus, the advantage of raising the load momentarily to increase the creep for only a short duration becomes readily apparent. With this in mind, a creep and load concept is described herein that can be engaged during fusing of stressful images or when thinner substrates are being fused.

Figure 5:
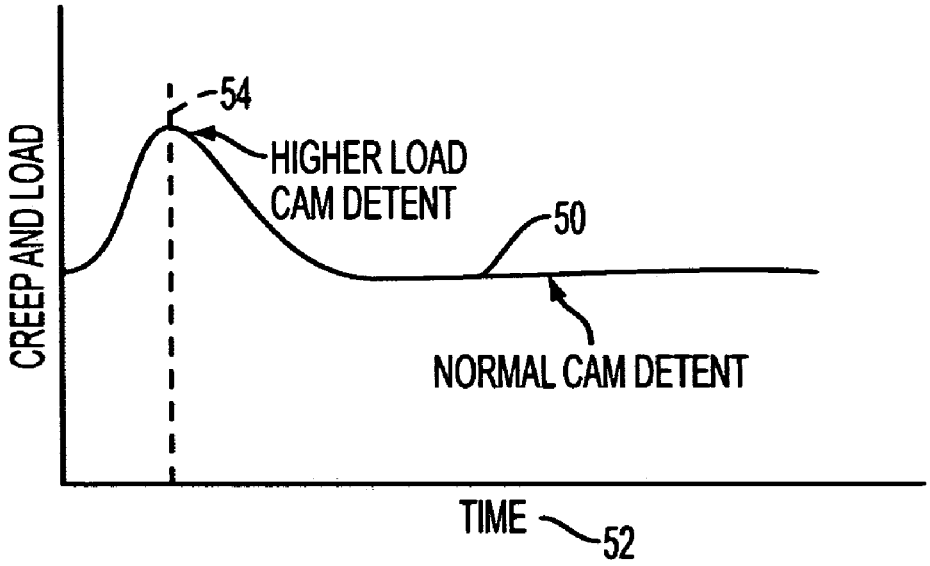
FIG. 5 is an example of a desired creep/load profile.
Figure 6:
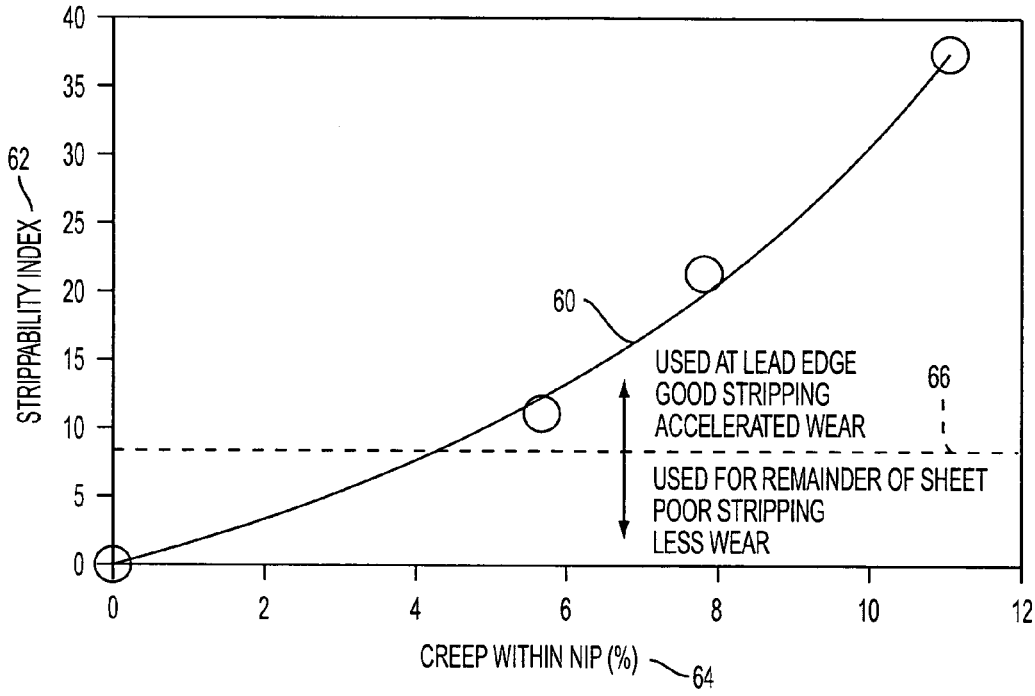
FIG. 6 is a graph showing a strippability index as a function of creep.

With reference now to FIG. 5, a loading/creep cycle is shown that varies the creep and load 50 as a function of time 52. For example, a higher creep and load is used at a point in time, represented by the dashed line 54, that is more important for successful stripping, e.g., when the leading edge of a substrate is in or about to exit the nip. Designers of the fusing system can balance the improved self-stripping capability against any decrease in material life for the short high-strain-energy durations, or potential damage, or other negative effects, arising from an inability to self-strip substrate from the fuser roll. For instance, with reference to FIG. 6, a strippability curve 60 is provided for one embodiment showing a strippability index 62 as a function of creep 64. The graph is divided into an upper portion and a lower portion by a dashed line 66. A strippability index above the dashed line is preferred for reliable stripping, however, operating with sufficient creep to aftain the desired strippability index accelerates wear on the system. Therefore, the desired strippability index is maintained only for the lead edge of the sheet, where it is most advantageous to have a high strippability index, and the creep is then reduced for the remainder of the sheet in order to lessen wear on the system.

With reference now to FIG. 7, a fuser system device arrangement is shown which accomplishes a momentary increase in creep as the leading edge of the substrate enters the nip. A mounting structure 70, pivotally supported by support member 71, is provided for the pressure roll 10 in which the pressure exerted upon the fuser member is momentarily increased by means of a rotating cam 72. The cam 72 exerts external pressure on the mounting structure 70 in timed coordination with the feeding of the substrate 16 through the nip 14 such that the load applied by the pressure roll 10 on the fuser roll 12 increases as the leading edge of the substrate passes through the nip, and returns to normal load shortly thereafter. The cam 72 is profiled with a lobe 74 which effectively accomplishes the loading/creep cycle shown previously in FIG. 5. The mounting structure 70 may include other load adjusting mechanisms 76 as is known in the art, e.g., adjustable springs, shims, etc.

In order for the cam 72 to exert external pressure on the mounting structure 70 in timed coordination with the feeding of the substrate 16 through the nip 14, a leading edge detector 78 is provided which is in operative communication with an actuator 80 such as, e.g., a cam actuator. The actuator 80 actuates the cam 72 at the proper time for the load applied by the pressure roll 10 on the fuser roll 12 to increase as the leading edge of the substrate passes through the nip as described above. The leading edge detector 78 may be selected from any of a variety of upstream paper sensors, e.g. flags, optical proximity, etc. Additionally, sensors may be included before and after the fuser in the paper/substrate path. Placing the sensor 78 before the nip 14 also allows for open loop control of the cam 72 actuation. Synchronizing can be accomplished by any method known in the art. For example, when the upstream sensor 78 detects the leading edge of a sheet of substrate, a delay can be calculated to actuate the cam 72 based on a current process speed.

While the embodiment shown in FIG. 7 is shown with a cam having a dwell profile which accomplishes the desired objectives of the present disclosure, it is to be appreciated that alternate device arrangements are included within the scope of the disclosure, and the disclosure is not limited to the embodiment shown. For example, the desired loading/creep cycle may be accomplished by means of hydraulic actuators or step motors operated in timed coordination with the feeding of substrate through the nip.

With reference now to FIG. 8, a xerographic system is shown schematically for illustrating the interrelationship between a toner image forming station 82, a transfer station 84, and a fuser system 86 as previously described, and including embodiments of the present disclosure. The fuser system 86 may include any of the embodiments described herein. The word xerographic system may encompass any apparatus such as a digital copier, bookmaking machine, facsimile machine, multi-function machine, etc. which performs a print outputting function for any purpose. Also shown in the xerographic system, for purposes of explanation, are a user interface 88, a substrate supply system 90, and a controller system 92. The controller system interacts with a user by displaying messages and system status information to the user, and receiving instructions from the user, via the user interface 88. The controller system 92 is operatively connected to each of the remaining components of the system for the purpose of receiving status information regarding the components, and controlling the operation of the various components.

The controller system 92 may also receive job or job segment information from the user via the user interface 88. This information may include information about a particular substrate or paper being supplied by the substrate supply system 90 for the job or job segment, e.g., type of substrate, thickness, etc. It is to be appreciated from the foregoing description that it would be advantageous to temporarily increase the creep when necessary, by increasing the load applied by the pressure roll 10 on the fuser roll 12, for the duration of a job or job segment based on the type of substrate being utilized. Therefore, in some embodiments, the control system 92 is configured to adjust the creep for the duration of a job or job segment by means of the load adjusting mechanism 76 or the cam 72, or a combination of both.

In still other embodiments, a substrate bending stiffness detector 94 is provided for automatically measuring the bending stiffness of the substrate currently being used, and communicating the bending stiffness data to the control system 92. Suitable substrate bending stiffness detectors are described by U.S. Pat. Nos. 6,581,456 and 6,772,628 to Robert A. Clark which are incorporated herein in their entirety. Although these bending stiffness detectors are suitable for the embodiments described herein, the present application is not limited with respect to the type of bending stiffness detector utilized. In some embodiments, the control system 92 is configured to automatically determine the bending stiffness of the substrate for a print job or job segment, and thereby automatically adjust the creep when necessary, by increasing or decreasing the load applied by the pressure roll 10 on the fuser roll 12 as previously described.

The described embodiments enable increased ppm productivity because of the improved self-stripping provided by concepts of the present disclosure and, at the same time, provide for a wide latitude with respect to the types of substrate media which will successfully be fused, e.g., thinner paper sheets. Further, these advantages have been achieved with minimal increase in strain energy, thereby reducing any undesirable side effects.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fuser system of a xerographic device, comprising:

a fuser member and a pressure member in which the pressure member is made to exert a predetermined pressure load upon the fuser member so as to:

form a nip having a nip width between the fuser member and the pressure member at least during normal fusing of a substrate; and establish a predetermined creep magnitude at least during normal fusing of the substrate; and a load adjustment device configured to momentarily increase the exerted pressure load as a leading edge portion of the substrate passes through, and/or in the vicinity of, the nip, thereby increasing the creep magnitude momentarily for only the leading edge portion of the substrate.

2. The fuser system according to claim 1, wherein the fuser member is a fuser roll.

3. The fuser system according to claim 2, the fuser member further including a fuser belt traveling around the fuser roll.

4. The fuser system according to claim 1, wherein the fuser member includes one or more layers of a silicone material.

5. The fuser system according to claim 1, wherein the pressure member is a pressure roll.

6. The fuser system according to claim 1, wherein the fuser system includes at least two sets each of a fuser member and a pressure member.

7. The fuser system according to claim 1, further including a pressure member mounting structure supporting the pressure member.

8. The fuser system according to claim 7, wherein the load adjustment device comprises a cam system.

9. The fuser system according to claim 8, wherein the cam system comprises a rotary cam acting on the pressure member mounting structure.

10. The fuser system according to claim 7, wherein the load adjustment device comprises a mechanism of the pressure member mounting structure that adjusts the pressure member mounting structure so that the pressure member is made to move toward or away from the fuser member.

11. A xerographic device comprising:

a toner image forming station;

a transfer station to transfer the toner image to an image receiving substrate; and a fuser system including:

a fuser member and a pressure member in which the pressure member is made to exert a predetermined pressure load upon the fuser member, thereby forming a nip having a nip width between the fuser member and the pressure member, and establishing a predetermined creep magnitude; and a creep adjustment system configured to momentarily increase the load and creep magnitude for only a leading edge portion of the substrate as the leading edge portion passes though, and/or in the vicinity of, the nip.

12. The xerographic device according to claim 11, wherein creep adjustment system includes a load adjustment device configured to increase the exerted pressure load as a leading edge of the substrate passes though, and/or in the vicinity of, the nip.

13. The xerographic device according to claim 12, further including a pressure member mounting structure supporting the pressure member.

14. The xerographic device according to claim 13, wherein the load adjustment device comprises a cam system.

15. The xerographic device according to claim 14, wherein the cam system comprises a rotary cam acting on the pressure member mounting structure.

16. The xerographic device according to claim 13, wherein the load adjustment device comprises a mechanism of the pressure member mounting structure that adjusts the pressure member mounting structure so that the pressure member is made to move toward or away from the fuser member.

17. The xerographic device according to claim 11, further including:

a user interface for receiving instructions and substrate properties from a user and displaying system status messages to the user;

a control system configured to adjust the creep for the duration of a print job or print job segment by controlling the load adjustment device based on the substrate properties.

18. A xerographic device comprising:

a toner image forming station;

a transfer station to transfer the toner image to an image receiving substrate;

a fuser system including:

a fuser member and a pressure member in which the pressure member is made to exert a predetermined pressure load upon the fuser member, thereby forming a nip having a nip width between the fuser member and the pressure member, and establishing a predetermined creep magnitude; and a creep adjustment system configured to momentarily increase the load and creep magnitude as a leading edge or other portion of the substrate passes though, and/or in the vicinity of, the nip;

a user interface for receiving instructions and substrate properties from a user and displaying system status messages to the user;

a control system configured to adjust the creep for the duration of a print job or print job segment by controlling the load adjustment device based on the substrate properties; and a substrate bending stiffness detector for automatically determining the bending stiffness of the substrate, the control system further configured to adjust the creep by controlling the load adjustment system based on the automatically determined substrate bending stiffness.

19. A method for improved self-stripping latitude associated with a fuser member and a pressure member in which the pressure member is made to exert pressure load upon the fuser member so as to form a nip having a nip width between the fuser member and the pressure member, and establish a predetermined creep magnitude at least during normal fusing of a substrate, the method comprising:

momentarily increasing the load and creep magnitude for only a leading edge portion of the substrate as the leading edge portion passes though, and/or in the vicinity of, the nip.

20. The method according to claim 19, wherein momentarily increasing the creep magnitude includes momentarily increasing the load exerted by the pressure member upon the fuser member.

21. The method according to claim 20, wherein the momentarily increasing the creep magnitude includes momentarily increasing the load exerted by the pressure member upon the fuser member, and rotating a cam, the rotating cam having a contour that momentarily increases the exerted pressure.

22. The method according to claim 20, wherein momentarily increasing the creep magnitude includes momentarily increasing the pressure exerted by the pressure member upon the fuser member, and rotating a cam in operative contact with a pressure member support structure, the rotating cam having a contour that momentarily moves the support structure, thereby increasing the exerted pressure.

23. A xerographic system, comprising:

a user interface for receiving instructions from a user and displaying system status messages to the user;

a fuser member and a pressure member in which the pressure member is made to exert a predetermined pressure load upon the fuser member so as to:

form a nip having a nip width between the fuser member and the pressure member at least during normal fusing of a substrate; and establish a predetermined creep magnitude at least during normal fusing of the substrate;

a load adjustment system configured to adjust the exerted load momentarily as a leading edge portion of the substrate passes through, and/or in the vicinity of, the nip, thereby adjusting the creep magnitude for only the leading edge portion of the substrate; and a control system configured to control the load adjustment system based on a determination of the substrate properties.

24. The xerographic system according to claim 23, wherein the substrate properties are determined based on input received from the user interface.

25. The xerographic system according to claim 24, wherein the substrate properties include substrate thickness.

26. A xerographic system comprising:

a user interface for receiving instructions from a user and displaying system status messages to the user;

a fuser member and a pressure member in which the pressure member is made to exert a predetermined pressure load upon the fuser member so as to:

form a nip having a nip width between the fuser member and the pressure member at least during normal fusing of a substrate; and establish a predetermined creep magnitude at least during normal fusing of the substrate;

a load adjustment system configured to adjust the exerted load as substrate passes through, and/or in the vicinity of, the nip, thereby adjusting the creep magnitude;

a control system configured to control the load adjustment system based on a determination of the substrate properties; and a substrate bending stiffness detector for automatically determining the bending stiffness of the substrate, the control system further configured to control the load adjustment system based on the automatically determined substrate bending stiffness.

* * * * *